United States Patent [19]

Gregory

[11] 4,263,801

[45] Apr. 28, 1981

[54] HYDRAULIC RIVETER

[76] Inventor: Jack T. Gregory, P.O. Box 556, San Anselmo, Calif. 94960

[21] Appl. No.: 73,677

[22] Filed: Sep. 10, 1979

[51] Int. Cl.[3] ..... B21J 15/34

[52] U.S. Cl. ..... 72/453.17; 60/479; 72/391; 81/301

[58] Field of Search ..... 72/391, 453.17, 453.15, 72/453.16; 29/243.53, 243.54; 81/301; 60/477, 478, 479

[56] References Cited

U.S. PATENT DOCUMENTS

| | | | |
|---|---|---|---|
| 2,714,250 | 8/1955 | Twedt | 81/301 |
| 3,329,000 | 7/1967 | Schwab | 72/391 |
| 3,996,784 | 12/1976 | Champoux | 72/391 |
| 4,086,802 | 5/1978 | Ewig | 72/391 |

FOREIGN PATENT DOCUMENTS

| | | | |
|---|---|---|---|
| 664846 | 6/1963 | Canada | 60/477 |
| 1383794 | 2/1975 | United Kingdom | 60/477 |

*Primary Examiner*—Charlie T. Moon
*Assistant Examiner*—Gene P. Crosby
*Attorney, Agent, or Firm*—Melvin R. Stidham

[57] ABSTRACT

A hydraulic tool comprising a cylinder which is open at one end with a piston extending partially therein, but having a substantial portion extending outside. A lateral bore through the extending portion accommodates intake and exhaust check valves, but the bore is sealed off between them, forming an inlet chamber. Surrounding the inlet and exhaust ports and sealed at its opposite ends to the piston and cylinder, respectively, is a flexible, extendable sleeve forming an annular reservoir. A transfer duct extends from the inlet chamber to a pressure chamber formed between two seals around the piston, and a longitudinal bore opens into the inlet chamber from the extending end of the piston to slidably accommodate a manually-operated pump plunger.

11 Claims, 7 Drawing Figures

HYDRAULIC RIVETER

BACKGROUND OF THE INVENTION

Rivets have widely replaced nuts and bolts as fastening devices in metal fabrication. They can provide a tight joint which can withstand considerable stresses and vibration without working loose. In production riveting, it is conventional practice to provide sizeable pneumatic riveters which require the availability of air compressors and hoses to the rivet guns. For riveting in the field, it is conventional to have rather massive tools capable of a substantial mechanical advantage in order to effect a firm attachment.

OBJECTS OF THE INVENTION

It is an object of this invention to provide a light weight, manipulable tool capable of placing rivets under extremely high force.

It is a further object of this invention to provide a riveter capable of production use without requiring air compressors or other sources of power.

It is a further object of this invention to provide a heavy duty riveter which is small and light in weight.

Other objects and advantages of this invention will become apparent from the description to follow, particularity when read in conjunction with the accompanying drawing.

BRIEF SUMMARY OF THE INVENTION

In carrying out this invention, I provide a hand tool containing a small cylinder, open at one end with a piston partially received therein, but having a substantial portion outside. A lateral bore through the piston carries an intake port on one side and an exhaust port on the other, both with one way check valves. Between them the bore is sealed off to form an inlet chamber. A flexible extendable sleeve surrounds the ports forming an annular reservoir which is sealed at its opposite ends to the piston and cylinder, respectively. A pump bore containing a plunger opens into the inlet chamber from the outside end of the piston and a transfer passage opens from the chamber to a pressure chamber formed within the cylinder between two seals on the piston. A hand screw presses the exhaust check valve against its seat to inactivate it during operation, and handgrips are squeezed repeatedly to reciprocate the pump plunger and draw fluid from the extendable annular reservoir into the inlet chamber and then force it to the pressure chamber to produce further extension of the cylinder. The mandrel of a rivet is inserted through an opening in the nose piece on the end of the cylinder and teeth on the end of the piston grip it. Hence, one rivet web is pulled toward the operator against the far side of a metal member and the other web is forced against the near side. After completion of this stroke, the mandrel breaks off and a spring trigger carried on the cylinder and slidable along the surface of the piston enters into the inlet port to force the check valve off its seat and prevent further pressurization of the tool. After the completion of the stroke, the hand screw is loosened to activate the exhaust check valve and the tool returns to its normal unpressurized state.

DESCRIPTION OF A PREFERRED EMBODIMENT

Figure 1:
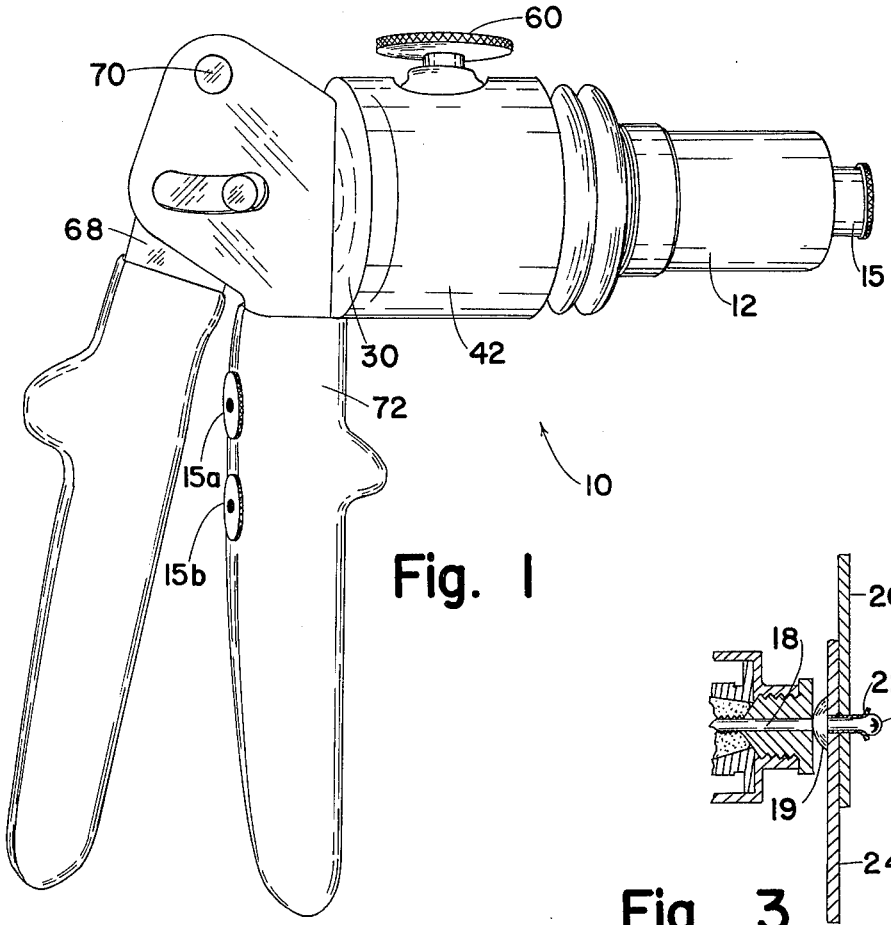
FIG. 1 is a view in perspective of a hydraulic riveter embodying features of this invention.
Figure 3:
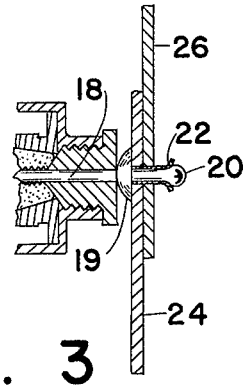
FIG. 3 is a partial section view showing the riveter in mid-stage of operation.
Figure 2:
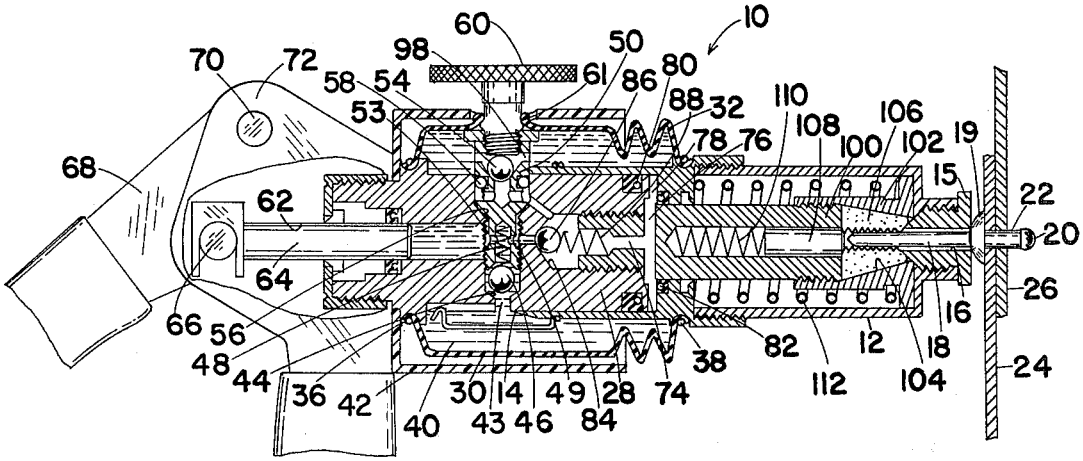
FIG. 2 is a vertical section taken through the body of the riveter.
Figure 7:
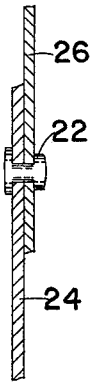
FIG. 7 is a section of two metal sheets with a rivet in place.

Referring now to FIGS. 1 and 2 with greater particularity, the hydraulic riveter 10 of this invention includes a cylinder 12 which is open at one end 14 and at the other end, carries a nosepiece 15. The nosepiece 15 has an opening therethrough just large enough to receive the mandrel 18 of a blind rivet, which includes a near side rivet element 18 and a far side plug 20 which is pulled through a frangible sleeve 22 to expand the sleeve and secure metal components 24 and 26 together, as shown in FIGS. 3 and 7.

Extending partially into the cylinder 12 and slidable therein is a piston 28, and sealed between the piston 28 and the cylinder 12 is a flexible, extensible sleeve 30 having a bellows portion 32 to facilitate extension as the cylinder 12 and piston 28 move relative to each other. The extensible sleeve is sealed at its opposite ends, with O-ring like lips 36 and 38 around the piston 28 and cylinder 12, respectively, and is spaced therefrom to form an annular reservoir 40 for hydraulic fluid. A plastic shroud 42 is secured over the reservoir sleeve 30 to protect it against puncture of other damage.

A radial bore 43 and counterbore 44 form a seat for a oneway, inlet ball check valve 46, which is biased by a spring 48 toward closed position. From the valve seat 44 the counterbore is tapped at 49 to threadedly receive an exhaust check valve 50 assembly, leaving a clearance around it to form an inlet chamber 53. A ball check 54 is operable to seal off an exhaust passage 55 in the valve assembly 50. A finished surface 56 at the base of the assembly seals off the exhaust passage 55 from the inlet chamber 53 and an O-ring 58 seals off the clearance around the valve assembly 50.

In normal operation, a hand operated screw 60 forces the exhaust ball check 54 against its seat to prevent fluid from returning to the reservoir 40. An O-ring like seal 61 integral with the extendible sleeve 30 seals around the stem of the screw 60.

A longitudinal bore 62, which opens into the inlet chamber 50 from the end of the piston 28 slidably receives a pump plunger 64 which is pinned at 66 to a moving handle 68 which, in turn, is pivoted at 70 to a stationary handle 72. The stationary handle 72 also carries extra nose pieces 15*a* and 15*b* (FIG. 1) for different size rivets.

Also opening from the inlet chamber 53 is a transfer duct 74, 76 which communicates with a pressure chamber 78 situated between two seals 80 and 82 between the cylinder 12 and piston 28, respectively. In the transfer chamber port 84 is formed a check valve seat which is engaged by a ball check 86 biased by a spring 88.

Figure 4:
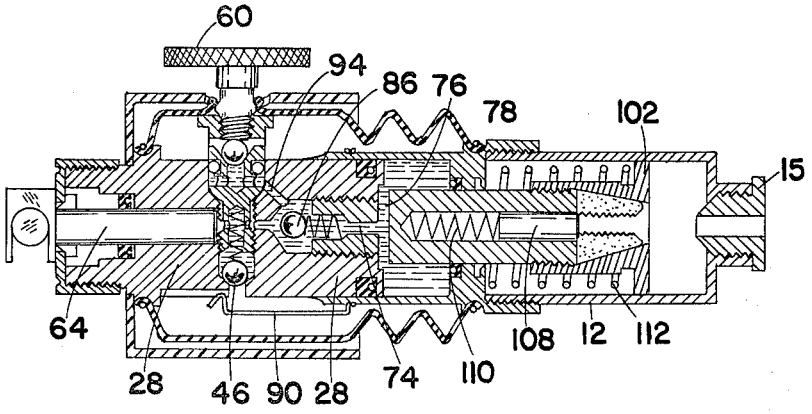
FIGS. 4, 5 and 6 are section views of the body of the rivet in various stages of operation.

In operation, the hydraulic system operates as follows. When the plunger 64 is withdrawn to the position shown in FIG. 2 fluid is drawn from the reservoir 40 through the inlet one-way check valve seat 44 and into the inlet chamber 53. In the meantime, the transfer check valve 86 prevents any return of fluid from the transfer duct 74 and 76. Then, when the plunger is pushed forward to the position shown in FIG. 4, the inlet check valve 46 is forced against its seat to prevent return flow to the reservoir and the transfer check valve 86 is forced from its seat to enable flow through the transfer duct 74 and 76 and into the expanding pressure chamber 78, driving the piston 28 further out of the cylinder 12. This pumping action illustrated in FIGS. 2 and 4 continues by repeated squeezing of the moveable handle 68 until the full stroke is reached.

Figure 5:
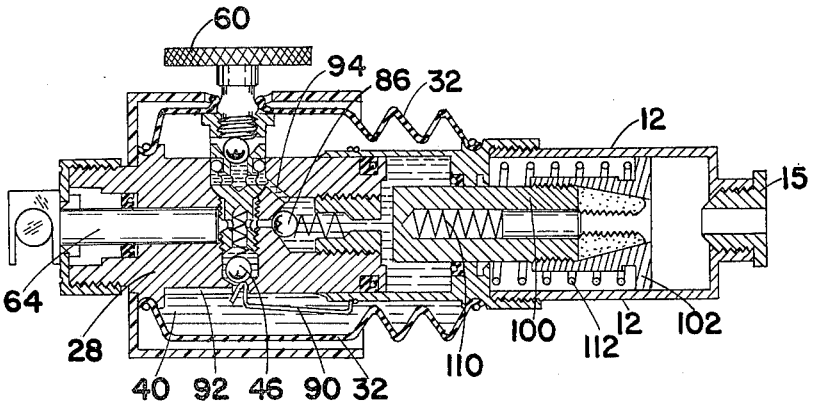

When the full stroke is reached, a spring trigger 90 which is carried on the cylinder 12, slides along a groove 92 formed in the piston 28, to move into the inlet port 42 and unseat the ball 46 at the end of the desired stroke. Hence, when the plunger is driven to its forward position shown in FIG. 5, fluid will tend to flow pass the ball check 46 to the lower pressure of the reservoir and is blocked off by the higher pressure acting against the transfer ball check 86. This prevents an operator from over pressurizing the system.

Figure 6:
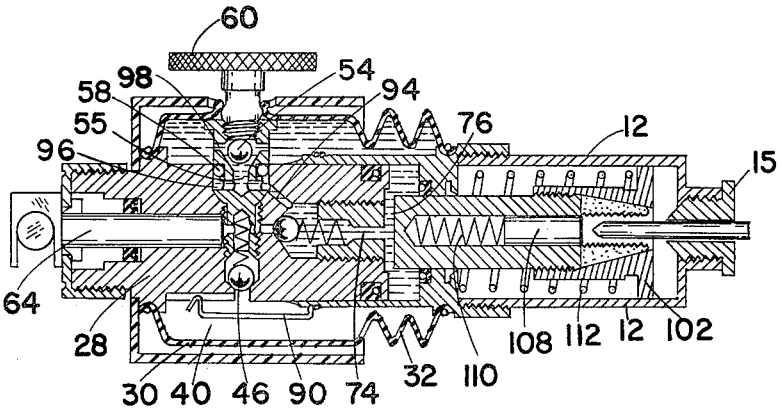

Finally, when the stroke has been completed the hand nut 60 is loosened as shown in FIG. 6 to allow the exhaust ball check 54 to be unseated and enable return of fluid from the transfer duct 74, 76 through the exhaust passages 94 and 55 and ports 98 to the reservoir 40.

Carried on an extension 100 on the piston 28 is a jaw holder 102 with an internal wedging surface 104 which acts against the outer surface of split jaws 106 which engage and grip the mandrel 18 of the blind rivet. The jaws are biased against the beveled surface 104 by a pusher member 108 bias by a spring 110. A stronger spring 112 acts between the jaw holder 102 and the cylinder 12 to bias them toward their initial positions shown in FIG. 2 when the pressure chamber 78 is exhausted.

In operation, a blind rivet is inserted through the nose piece 14 and the jaw pusher 108 causes jaws to grip the mandrel 18. Then, the system is pressurized as previously described by pumping the moveable handle 68 and moving the piston 28 to the left in FIG. 1 while the nose piece holds the rivet member 18 against the metal sheet 24. As pressure builds up, this pulls the ball 20 through the frangeable sleeve 22, spreading it out, as shown in FIG. 3 until it reaches the position shown in FIG. 7, at which time the mandrel 18 is designed to fracture and break away. Thereafter, the hand nut 60 is loosened to depressurize the pressure chamber 78 and allow the spring 112 to return the cylinder 12 and piston 28 to their initial relative positions.

While this invention has been descrbied in conjunction with a preferred embodiment thereof, it is obvious that modifications and changes therein may be made by those skilled in the art without departing from the spirit and scope of this invention, as defined by the claims appended hereto.

Having described my invention I claim:

1. A hydraulic tool comprising:

a cylinder open at one end;

a piston slidable in said cylinder with a portion thereof extending outward from said one end throughout the full stroke thereof;

first and second seals around and between said piston and said cylinder forming a pressure chamber between them, which when pressurized forces said cylinder to a more extended position;

an extendable sleeve forming a reservoir embracing said extending portion and said one end of the cylinder and sealed thereto at opposite ends;

an inlet chamber in the extending portion of said piston;

an inlet port between said reservoir and said inlet chamber;

a first one-way check valve in said inlet port enabling inward flow only;

a transfer duct in said piston between said inlet and pressure chambers;

a second one-way check valve in said transfer duct enabling flow towards said pressure chamber only; and pump means for drawing fluid from said reservoir into said inlet chamber and forcing same from said inlet chamber to said pressure chamber.

2. The hydraulic tool defined by claim 1 including:

spring trip means carried on said cylinder and slidable along said extending portion;

said trip means being conditioned, when disposed opposite said port to enter therein and unseat said first check valve.

3. The hydraulic tool defined by claim 1 wherein said extendable sleeve comprises:

a sleeve of flexible material with sealing lips formed around the ends thereof for sealing engagement with said extending portion and said cylinder, respectfully;

a bellows formed in said sleeve.

4. The hydraulic tool defined by claim 1 including:

an exhaust port connected to said reservoir;

a third one-way check valve in said exhaust port;

an exhaust duct from said exhaust port into said transfer duct; and means for locking said one-way check valve in sealing position.

5. The hydraulic tool defined by claim 1 including:

jaw means on the inner end of said piston for gripping the mandrel of a blind rivet; and a nosepiece on the other end of said cylinder with a hole therethrough to slidably receive said rivet mandrel.

6. The hydraulic tool defined by claim 1 including:

a lateral bore through the extending portion of said piston forming said inlet port;

a first counterbore therein forming said inlet chamber and a first seat for said first check valve;

a second larger counterbore extending to said first counterbore;

an exhaust valve body with an exhaust duct therein received in said second counterbore;

a lower extension depending from said exhaust valve body threadedly received in said first counterbore;

a finished surface on said exhaust valve body engaging and sealing off communication between said first and second counterbores; and a resilient seal ring around said exhaust valve body.

7. The hydraulic tool defined by claim 1 wherein said pump means comprises:

a longitudinal bore in said piston from the extending end thereof to said inlet chamber; and a plunger slidable in said bore and extending therefrom.

8. The hydraulic tool defined by claim 7 including:

manually-operated means on the extending end of said piston for reciprocating said plunger.

9. The hydraulic tool defined by claim 7 including:

a stationary handle element fixed to the extending end of said piston to extend generally radially therefrom;

a movable handle element pivoted at one end to an end of said stationary element; and a pivotal connection between said movable handle and the extending end of said plunger.

10. The hydraulic tool defined by claim 4 including:

a lateral bore through the extending portion of said piston forming said inlet port, a counterbore therein forming said inlet chamber and a first seat for said first one-way check valve; and a third seat for said third one-way check valve received in said counterbore.

11. The hydraulic tool defined by claim 10 including:

a manually operated screw threaded in the direction of said third seat which, then advanced holds said third check valve against said third seat.

* * * * *